United States Patent [19]

Ruepp

[11] 4,397,103

[45] Aug. 9, 1983

[54] TEXTILE FABRIC DRYER WITH ROTARY DAMPER ARRANGEMENT

[75] Inventor: Ferdinand Ruepp, Charlotte, N.C.

[73] Assignee: American Artos Corporation, Charlotte, N.C.

[21] Appl. No.: 287,164

[22] Filed: Jul. 27, 1981

[51] Int. Cl.[3] ..... F26B 13/02

[52] U.S. Cl. ..... 34/155; 34/160; 34/191

[58] Field of Search ..... 34/191, 155, 156, 160, 34/54, 225, 233; 137/624.13, 624.18

[56] References Cited

U.S. PATENT DOCUMENTS 2,508,396 5/1950 Jordan ..... 137/624.13
3,705,461 12/1972 Parkes ..... 34/191

FOREIGN PATENT DOCUMENTS 2810178 9/1979 Fed. Rep. of Germany .

*Primary Examiner*—Larry I. Schwartz
*Attorney, Agent, or Firm*—Bell, Seltzer, Park & Gibson

[57] ABSTRACT

A textile fabric dryer of the alternating flow type is provided with an improved damper arrangement in which rotatable damper elements are mounted for rotating movement between open and closed positions to direct the flow of heated air alternately on opposite sides of the fabric.

8 Claims, 6 Drawing Figures

TEXTILE FABRIC DRYER WITH ROTARY DAMPER ARRANGEMENT

FIELD AND BACKGROUND OF THE INVENTION

This invention relates to an apparatus for the continuous drying of textile fabric, and more particularly, relates to an improvement in a textile fabric dryer of the alternating flow type.

Alternating flow textile fabric dryers are known in the art. This type of dryer is characterized by having a mechanism for continuously carrying fabric through the dryer, and an air flow arrangement in which heated air is alternately directed toward the fabric from opposite sides thereof as the fabric is moved through the dryer. In one well-known commercially available dryer of this type, the fabric is supported as it moves through the dryer housing by an open-mesh conveyor belt. The air is alternately directed toward the fabric from above and below, in such a way that the air flows downwardly through the fabric and through the underlying open-mesh conveyor belt when the air is directed from above, and periodically, when the air is directed from below, the fabric is lifted from the conveyor belt to permit free shrinking and bulking of the fabric.

In this known type of dryer, the air flow is directed in an alternating manner by means of dampers of the hinged door type. The hinged damper door is moved in a reciprocating manner to direct the flow of air first above and then below the fabric. Because of the relatively high air flow rates used in this type of dryer and the rapid reciprocating motion of the damper parts, this type of damper arrangement is relatively expensive to maintain and somewhat complicated to control.

SUMMARY OF THE INVENTION

With the foregoing in mind, it is an object of the present invention to overcome the aforementioned limitations and problems of the prior dryer constructions.

In accordance with the present invention, an alternating flow type textile fabric dryer is provided with an improved type of damper having damper elements which are mounted for rotating movement between open and closed positions so as to direct the flow of heated air alternately on opposite sides of the fabric. The damper arrangement of this invention utilizes a continuous rotating movement of the damper elements which functions smoothly and efficiently to direct the flow of air in an alternating manner toward opposite sides of the fabric. This arrangement avoids the necessity of having reciprocating parts and the attendent problems of wear and alignment associated therewith.

The textile fabric dryer of the present invention comprises a housing, means for conveying continuous length textile fabric along a predetermined path of travel through the housing, means defining a first air passageway located on one side of the fabric in its path of travel through the housing, means defining a second air passageway located on the opposite side of the fabric in its path of travel through the housing, means for creating a flow of heated air in the housing for drying the fabric, and damper means mounted in the path of flow of the heated air in the housing. The damper means has rotatable damper elements cooperating respectively with the first and second air passageways, and the damper elements are mounted for rotating movement between open and closed positions to direct the flow of heated air alternately through said first and second air passageways so that the air is discharged therefrom alternately on opposite sides of the fabric.

The damper means, more particularly, includes a frame having first and second openings arranged substantially side-by-side and communicating respectively with the first and second air passageways, and the rotatable damper elements are carried by the frame and mounted for rotating movement in the first and second openings. The rotatable damper elements preferably comprise first and second blades mounted respectively in the openings of the frame, the blades being oriented in out-of-phase relation with one another such that one of the blades is in a closed position blocking the opening in the frame while the other blade is in an open position.

In a preferred embodiment of the invention, the blades are mounted for rotational movement about an axis extending substantially midway between opposite edges of the blade, and the frame includes a pair of arcuately shaped walls positioned on opposite sides of the rotational axis of each blade and serving to define the respective openings in the frame. The arcuate shape of the walls corresponds substantially to the path of travel of opposite edges of the blades so as to cooperate with the blades to substantially block the flow of air through the opening. These walls have an arcuate extent of about 90 degrees so that during rotation of the respective blades, each blade assumes a closed position blocking the flow of air for approximately 90 degrees of rotational movement of the blade, and then assumes an open position for the next 90 degrees of rotational movement. By this arrangement, one of the damper blades opens at approximately the same time as the other blade closes to thereby direct the air flow alternately above and below the fabric in a well-controlled smooth and efficient manner.

A common drive means is connected to both of the blades and is operable for continuously rotating the blades at a predetermined rate of speed. The frequency of alternation of the air flow can be readily varied by adjusting the speed of rotation of the blades.

BRIEF DESCRIPTION OF THE DRAWINGS

Some of the features and advantages of the invention having been stated, other will become apparent as the description proceeds, when taken in connection with the accompanying drawings, in which—

DESCRIPTION OF ILLUSTRATED EMBODIMENT

Figure 1:
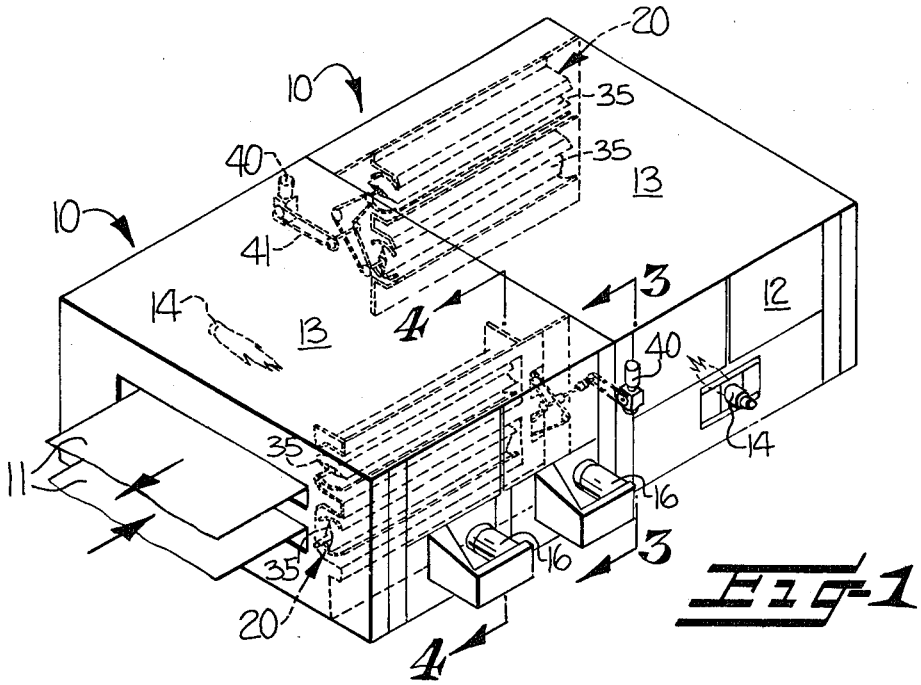
FIG. 1 is a perspective view showing a continuous textile fabric dryer, with the damper arrangement of the invention shown in broken lines.

Referring now more particularly to the drawings, in FIG. 1 there is illustrated an apparatus for continuously drying textile material and which comprises a series of dryer units, each indicated by the reference character 10, of substantially identical construction and which are arranged end-to-end in the material conveying direction. Two such units are shown, but it will be understood that a typical dryer installation may include additional units. An endless air permeable conveyor belt 11 extends longitudinally through the units 10 for continuously conveying textile fabric through the respective dryer units. Typically, the fabric is deposited onto the conveyor in an overfed condition so that it rests on the conveyor belt in a loose and randomly folded arrangement.

Each unit 10 has a housing with an inlet at one end and an outlet at the opposite end through which the elongate conveyor belt passes and with a pair of opposing side walls 12 extending longitudinally in the material conveying direction alongside opposite sides of the conveyor belt 11. A top wall or roof 13 extends horizontally between opposite side walls 12 to enclose the housing. Within the housing of each dryer unit 10 means is provided for creating a flow of heated air for drying the fabric. Heating of the air is accomplished by a heater 14 located in the lower portion of the housing. In the particular embodiment illustrated, the heater 14 comprises a gas fired burner, although it will be readily appreciated that other types of heaters can be suitable employed. The heated air is circulated throughout the housing by a pair of radial flow fans 15 (FIG. 4) located within the housing adjacent one of the side walls 12. The fans 15 are powered by motors 16 located outside the housing. As seen in FIG. 1, rotary damper means, generally indicated at 20 is located above the fans 15 alongside the longitudinal path of travel of the conveyor belt 11 for controlling the flow of heated air in an alternating manner above and below the conveyor belt as will be described more fully hereinafter. As illustrated, the rotary damper means 20 is of an elongate construction and extends longitudinally substantially the full distance between the inlet and outlet ends of the damper of the housing so that the air passing through the damper the means is directed into contact with the fabric over substantially the full longitudinal extent of the dryer unit.

Figure 4:
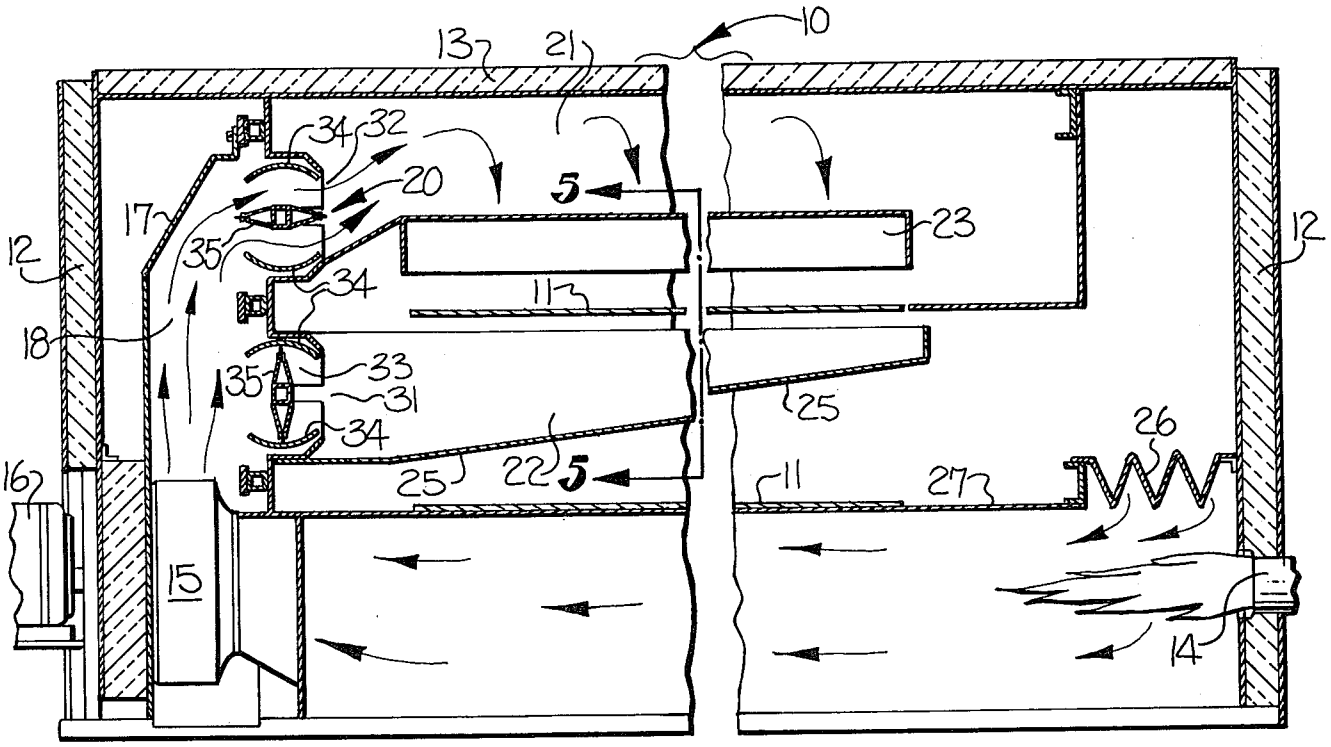
FIG. 4 is a sectional view through the dryer taken substantially along the line 4—4 of FIG. 1.
Figure 3:
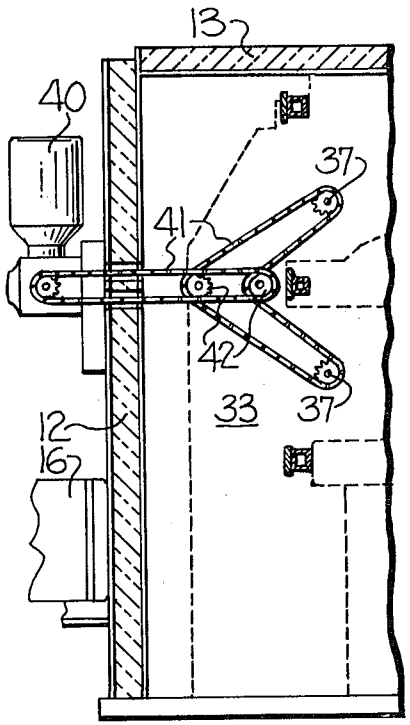
FIG. 3 is a partial section view through the dryer taken substantially along the line 3—3 of FIG. 1.

The path of flow of the air through the dryer is best understood from FIG. 4. As illustrated, the heated air, upon being discharged from the fans 15, is directed upwardly into an enclosed plenum area 18 defined between a wall 17 and the rotary damper means 20. Depending upon the position of the damper elements, as will be described more fully hereinafter, the air is discharged from the damper means either above or below the fabric into respective air passageways, 21, 22 communicating with the damper means.

Figure 5:
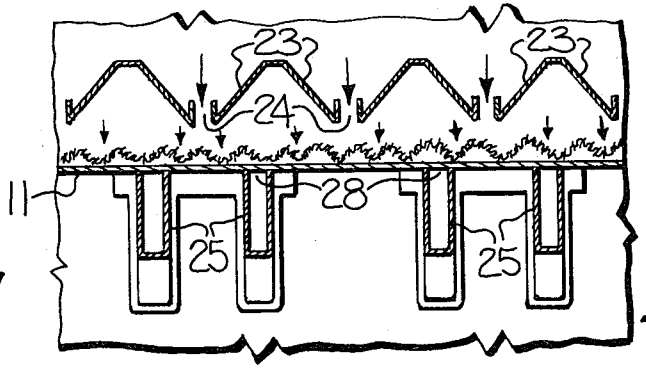
FIG. 5 is a fragmentary sectional view through the dryer in the material conveying direction taken substantially along the line 5—5 of FIG. 4 and wherein the heated air is being directed downwardly toward the fabric.

In the area above the fabric where air passageway 21 is located, a series of air baffles 23 extend horizontally from the damper means across the width of the conveyor and generally parallel thereto. As seen in FIG. 5, the baffles 23 are of a generally "V" shaped configuration and have a series of openings 24 serving as nozzles for directing the air flow from the air passageway 21 downwardly toward the fabric. The air passes through the fabric, through the open mesh conveyor 11, between the lower air ducts 25 and through a lint screen 26 where the air is heated by the burner 14 and returns to the fans 15. As the air flows downwardly through the fabric and through the underlying conveyor belt 11, as shown in FIG. 5, the fabric remains in a loose folded condition resting on the surface of the open mesh conveyor belt 11. A horizontal dividing wall 27 extends between the lint screen 26 and the fans 15 and separates the return flow of heated air from the air flow in the upper portion of the dryer.

Figure 6:
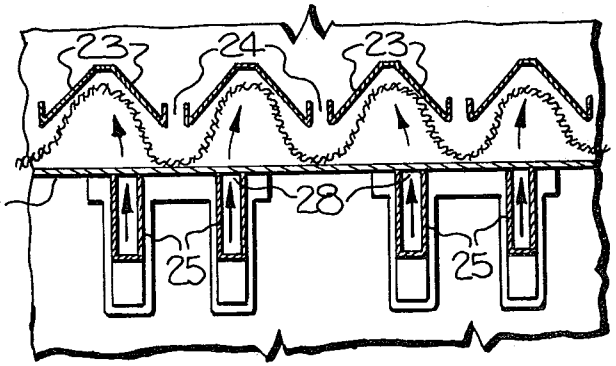
FIG. 6 is a view similar to FIG. 5 but wherein the heated air is being directed upwardly.

The lower air passageway 22 is defined by a series of generally horizontally extending air ducts 25 which communicate with the lower portion of the rotary damper means 20 and extend horizontally beneath the fabric in longitudinally spaced apart relation from one another. The lower air ducts 25 have a series of nozzles or openings 28 provided on the upper side thereof adapted for directing air upwardly toward the fabric. When air is directed through the lower air ducts 25, as illustrated in FIG. 6, the upward air flow lifts the fabric from the conveyor belt 11 to facilitate free shrinkage and bulking of the fabric.

Figure 2:
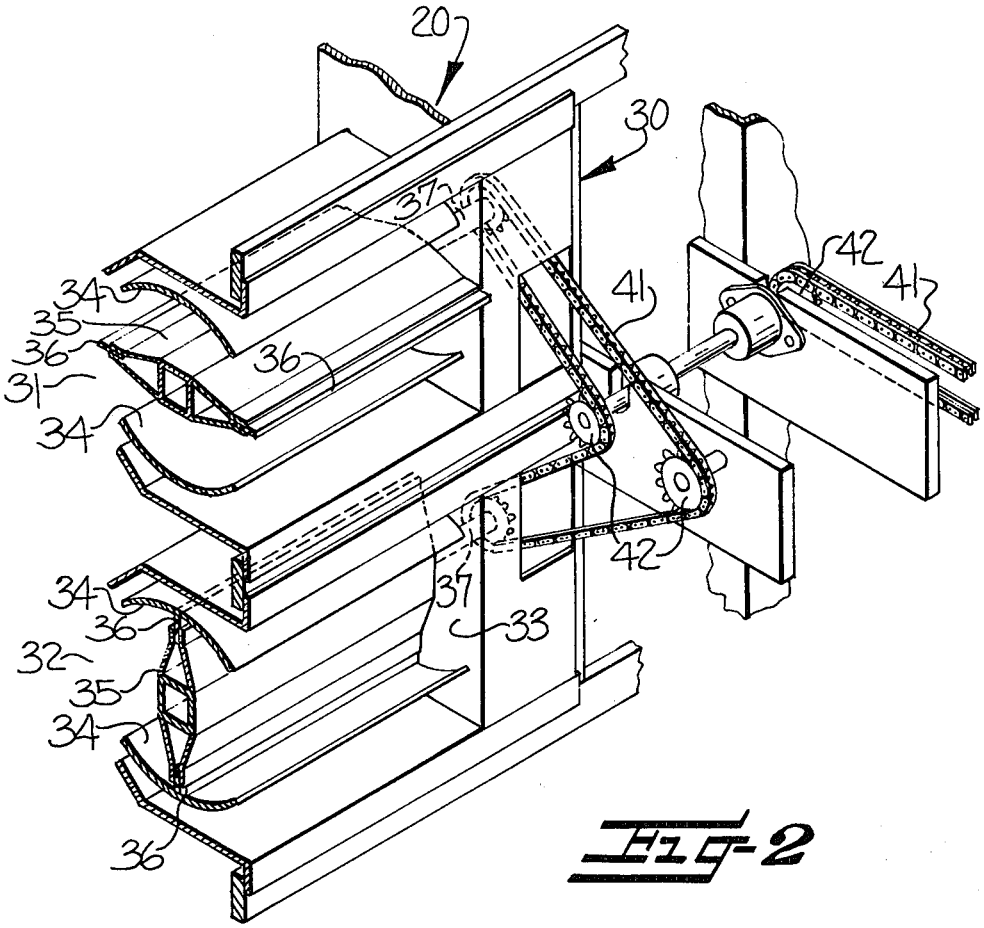
FIG. 2 is an enlarged fragmentary detailed perspective view of the damper arrangement.

Referring now in more detail to the construction of the rotary damper means 20, as seen best in FIG. 2, the damper means includes a frame, generally indicated at 30 having a pair of elongate generally horizontally extending openings 31, 32 positioned in side-by-side relation one above the other and serving to provide communication between the air supply plenum 18 behind the damper means and the respective upper and lower air passageways 21, 22.

The frame 30 more particularly includes a pair of opposing upright members 33 at opposite ends thereof and respective elongate arcuately shaped walls 34 carried by and extending longitudinally between the opposing upright members 33. The arcuate walls 34 are arranged in pairs in opposing spaced relation to one another and define opposite sides of the respective upper and lower openings 31, 32. Elongate damper elements 35 are mounted in the respective upper and lower openings 31, 32 for controlling the flow of air through the respective openings. The damper elements 35 are of an elongate blade-like configuration and have longitudinally extending edges 36 adapted to cooperate with the arcuate walls 34 for blocking the flow of air through the respective openings. The blade-like damper elements 35 are mounted for rotation about an axis extending longitudinally of the blades substantially midway between opposite edges 36 thereof, with a shaft 37 extending axially from opposite ends of the damper elements and being supported by the upright frame members 33.

As illustrated, the damper elements 35 are mounted in out-of-phase relation extending generally perpendicular to one another so that one of the blades is in a closed position while the other blade is in an open position. A common drive means is connected to the two damper blades for effecting simultaneous rotation of the blades so that the respective blades alternate between an open and closed position to thereby direct the flow of air alternately into the upper and lower air passageways, 21, 22. As illustrated, the common drive means includes a variable speed motor 40 mounted outside the housing. The motor is connected by suitable means, such as a chain 41 and sprockets 42 to the shafts 37 of the damper blades.

The arcuate walls 34 which define opposite sides of the respective openings are arranged on opposite sides of a common axis corresponding to the axis of rotation of the damper blades, and the radius of curvature of the arcuate wall corresponds substantially to the distance from the axis of the blade 35 to each edge 36 thereof. The walls 34 thus cooperate with the edges 36 of the damper blades during a portion of the rotation of the blades about their respective axis to block the flow of air through the openings. As illustrated, the arcuate extent of the walls 34 is approximately a 90 degree arc. Thus, as each blade rotates, the blade assumes a closed position blocking the flow of air for approximately 90 degrees of its rotation and then assumes an open position for the next 90 degrees of rotation. Since the two damper blades are mounted out-of-phase and approximately perpendicular to one another, it will be seen that as the blades rotate, one blade goes from an open position to a closed position at approximately the same time that the other blade goes from a closed position to an open position. Thus, by continuously rotating the blades at a predetermined rate of speed, the air flow is directed alternately first through one opening and then through the other. Since there is no reciprocating movement, the damper blades run smoothly and quietly to continuously direct the air flow in this alternating manner. By adjusting the variable speed motor, the frequency at which the air flow changes can be varied as desired. Typically, in fabric dryers of the type shown, the air flow alternates at a rate of about 60–200 cycles per minute.

In the drawings and specification, there has been set forth a preferred embodiment of the invention, and although specific terms are employed, they are used in a generic and descriptive sense only and not for purposes of limitation.

What is claimed is:

1. In an apparatus for the continuous drying of textile fabric, said apparatus comprising a housing having an inlet and outlet at opposite ends thereof and opposing side walls extending longitudinally therebetween, an air permeable conveyor belt extending longitudinally along a predetermined substantially horizontal path of travel through said housing from said inlet to said outlet for conveying textile fabric through said housing, means defining a first air passageway extending across and above said conveyor belt and longitudinally along the length thereof, means defining a second air passageway extending across and below said conveyor belt and longitudinally along the length thereof, said first and second air passageways having a common end thereof open for receiving a flow of air and each having a series of nozzles at longitudinally spaced locations along the path of travel of said conveyor belt and being oriented toward the conveyor belt for directing the air toward the textile fabric, blower means for directing a flow of heated air through said housing for drying the fabric, and damper means mounted in said housing between said air passageways and said blower means and operable for directing the heated air alternately into said first and second air passageways, the improvement wherein, said damper means comprises a frame having first and second openings arranged one above the other and extending longitudinally of said housing alongside said longitudinally extending conveyor belt, said first and second openings communicating respectively with the open ends of said first and second passageways, respective rotatable damper elements carried by said frame and each being mounted for rotating movement in one of said openings for movement between an open position permitting flow of air through the opening and a closed position substantially blocking the opening and preventing flow of air therethrough, and a common drive means connected to said damper elements for continuously rotating the respective damper elements in a predetermined rotational direction and in out of phase relation with one another such that one of the damper elements is oriented in a closed position substantially blocking the opening in the frame while the other damper element is oriented in an open position whereby the flow of heated air is directed alternately through said first and second air passageways and is discharged through said nozzles alternately toward opposite sides of the fabric.

2. Apparatus according to claim 1 wherein the openings in said frame are of an elongate rectangular configuration and extend substantially the full length of said housing in the material conveying direction, and wherein said damper elements comprise first and second elongate rectangular blades mounted respectively in said openings and having dimensions corresponding substantially to the dimensions of said openings.

3. Apparatus according to claim 2 wherein said elongate rectangular blades are mounted for rotating movement about an axis extending substantially midway between opposite longitudinal edges thereof.

4. In an apparatus for the continuous drying of textile fabric, said apparatus comprising a housing, means for conveying continuous length textile fabric along a predetermined path of travel through said housing, means defining a first air passageway located on one side of the fabric in its path of travel through the housing, means defining a second air passageway located on the opposite side of the fabric in its path of travel through the housing, means for creating a flow of heated air in said housing for drying the fabric, and damper means mounted in the path of flow of the heated air in said housing and operable for directing the heated air alternately into said first and second air passageways, the improvement wherein, said damper means comprises first and second damper blades, each mounted for rotational movement about a respective axis extending substantially midway between opposite edges thereof, and a frame having a pair of arcuately shaped walls positioned on opposite sides of the rotational axis of each of said blades and defining respective openings in said frame communicating with said passageways, said damper blades cooperating with said arcuately shaped walls so that during rotation of said blades, one of the blades is in a closed position blocking the opening in the frame while the other blade is in an open position to thereby direct the flow of heated air alternately through said first and second air passageways so that the air is discharged therefrom alternately on opposite sides of the fabric.

5. Apparatus according to claim 4 wherein the arcuate shape of said walls corresponds substantially to the path of travel of opposite edges of said blades so as to cooperate with the blades to substantially block the flow of air through the opening, and wherein the arcuate extent of said walls is about 90 degrees so that during rotation of the respective blades, each blade blocks the flow of air during a 90 degree rotational movement of the blade.

6. Apparatus according to claim 4 wherein said damper means includes a common drive means connected to said damper elements and operable for moving said elements in continuous rotational movement between said open and closed positions.

7. In an apparatus for the continuous drying of textile fabric, said apparatus comprising a housing, conveyor means extending along a predetermined substantially horizontal path of travel through said housing for conveying textile fabric through said housing, means defining a first air passageway located above said conveyor means and having a plurality of air discharge openings oriented toward said conveyor means for directing air onto the textile fabric as it is conveyed through the housing, means defining a second air passageway located beneath said conveyor means and having a series of air discharge openings oriented toward said conveyor means for directing air into contact with the textile fabric, means for creating a flow of heated air in said housing for drying the fabric, and damper means mounted in said housing in the path of flow of the heated air and operable for directing the heated air alternately into said first and second air passageways, the improvement wherein, said damper means comprises a frame having first and second openings arranged substantially side-by-side and communicating respectively with said first and second air passageways, first and second rotatable damper blades mounted to said frame for rotating movement in said first and second openings, said frame including a pair of arcuately shaped walls positioned on opposite sides of the rotational axis of each of said blades and defining the respective openings in said frame, said arcuately shaped walls having an arcuate shape corresponding substantially to the path of travel of opposite edges of the blades so as to cooperate with opposite edges of the blades to substantially block the flow of air through the opening, and means for continuously rotating said damper blades between open and closed positions in out-of-phase relation with one another for thereby directing the flow of air alternately through said first and second air passageways so that the air flows alternately toward the fabric from opposite sides thereof.

8. Apparatus according to claim 7 wherein said arcuately shaped walls have an arcuate extent of about 90 degrees, and the opposing pairs of arcuately shaped walls cooperate with the respective blades such that as the blades rotate, one blade assumes a closed position blocking the flow of air for approximately 90 degrees of rotational movement and then assumes an open position for the next 90 degrees of rotational movement, and one blade goes from an open position to a closed position at approximately the same time that the other blade goes from a closed to an open position.

* * * * *